United States Patent [19]

Pfeiffer

[11] 4,159,588

[45] Jul. 3, 1979

[54] APPARATUS FOR SUPPORTING SPORTING GUNS DURING TESTING INTERVALS

[76] Inventor: Hans W. Pfeiffer, Am Eisenwerk, Plettenberg, Fed. Rep. of Germany

[21] Appl. No.: 819,616

[22] Filed: Jul. 27, 1977

[30] Foreign Application Priority Data

Aug. 19, 1976 [DE] Fed. Rep. of Germany ..... 2637368

[51] Int. Cl.[2] ..... F41C 29/00; A47F 7/00

[52] U.S. Cl. ..... 42/90; 42/1 R; 211/64

[58] Field of Search ..... 42/1 R, 94, 90; 89/14 A; 73/167; 211/64

[56] References Cited

U.S. PATENT DOCUMENTS 2,126,792 8/1938 MacGregor ..... 89/14 A 2,285,035 6/1942 Kenney et al. ..... 211/64

2,337,840 12/1943 Scott-Paine et al. ..... 89/14 A

FOREIGN PATENT DOCUMENTS 703943 3/1941 Fed. Rep. of Germany ..... 89/14 A

*Primary Examiner*—Charles T. Jordan

*Attorney, Agent, or Firm*—Blanchard, Flynn, Thiel, Boutell & Tanis

[57] ABSTRACT

An apparatus for supporting sporting guns during test-firing intervals and for cooling the gun barrel. The apparatus has a frame provided with supports for the sporting gun. The frame comprises a conduit extending at an inclined position relative to the ground for receiving at least the barrel of the supported sporting gun and being adapted to have a gaseous cooling medium conducted therethrough.

9 Claims, 1 Drawing Figure

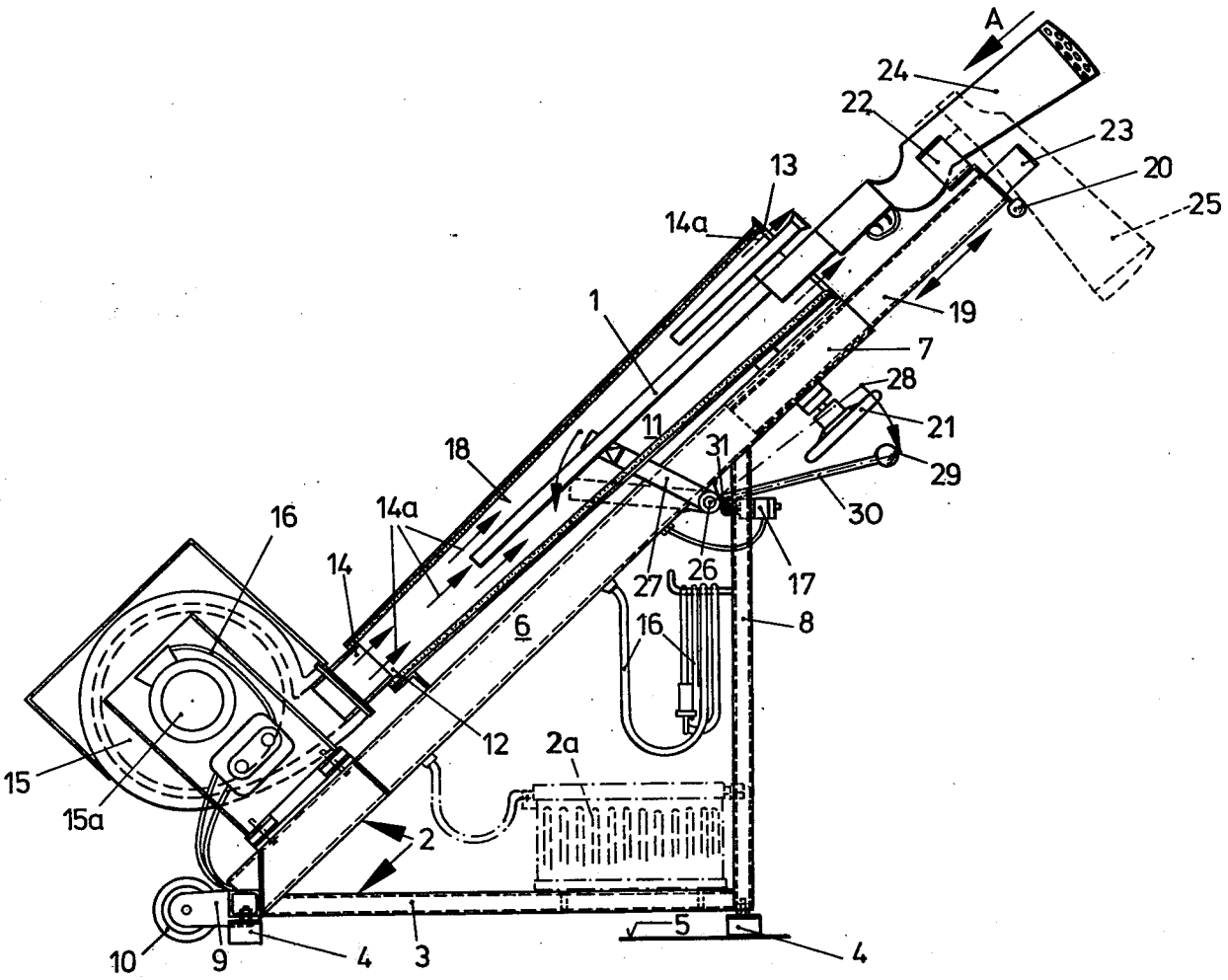
A
1
2
2a
3
4
5
6
7
8
9
10
11
12
13
14
14a
15
15a
16
17
18
19
20
21
22
23
24
25
26
27
28
29
30
31

APPARATUS FOR SUPPORTING SPORTING GUNS DURING TESTING INTERVALS

FIELD OF THE INVENTION

This invention relates to apparatus for supporting sporting guns during test-firing intervals and for cooling the gun barrel, consisting of a frame provided with supports for the sporting rifle.

BACKGROUND OF THE INVENTION

For the owners of sporting rifles there exists a recurrent necessity to test-fire their guns, e.g. for adjusting a telescopic sight or a diopter sight or for determining the accuracy after a change of ammunition. Testing of a gun requires a certain number of shots to be fired and cannot, however, be carried out without interruption, since the barrel of the gun under test heats up rather quickly.

This requires the sporting gun to be stood aside for cooling or, in order to avoid it being damaged, to be retained in a gun stand, inasmuch as otherwise the gun barrel might be harmfully affected by overheating. Cooling of the gun barrel requires considerable time, however, so that test firing of a sporting gun is a rather time-consuming operation.

It is thus an object of the invention to provide means enabling the period of time required for cooling a shot-heated gun barrel to be considerably shortened.

For attaining this object, the invention provides that the frame comprises a conduit extending at an inclined position relative to the ground for receiving at least the barrel of the supported sporting gun and being adapted to have a gaseous cooling medium conducted therethrough.

In this manner it is possible to considerably shorten the time required for cooling of a shot-heated gun barrel, so that test-firing of a sporting gun requires only short intervals.

In greater detail the invention provides that a blower driven by an electric motor is connected to the lower end of the conduit for feeding a gaseous cooling medium thereto.

Use is made of a high-performance blower. The inclined position of the conduit receiving the heated gun barrel results in the cooling air flow being directed obliquely upwards, so that the possibly warm air stream will not whirl up any loose particles from the ground or molest any persons staying in the shooting stand.

The invention further provides that the conduit gradually widens towards its upper end and has its inner side insulated by means of a heat-resistant, resiliently flexible material.

This provision ensures that the gun barrel to be cooled may be introduced into the conduit e.g. with a telescopic sight attached thereto, and that the cross-section of the conduit has only to be dimensioned such that the sporting gun, or the barrel, respectively, is enclosed on all sides by an air stream just adequate to carry off the heat. The lining or insulation of the conduit serves to protect the gun barrel against damage in case of it being introduced less carefully. At the same time the turbulence of the air stream along the insulation or lining of the conduit prevents heat transmission thereto.

In an advantageous embodiment of the support apparatus the invention provides that the conduit with its blower is supported on a tubular frame member extending at an inclined position relative to the ground and carrying the support members for the respective sporting gun, said frame member comprising a telescopically extensible and lockable tubular profiled rod carrying at its projecting upper end a pair of support members in the form of forks disposed at an angular spacing of 90°, one of said forks serving as a support member for a gun stock extending substantially in the direction of the gun barrel, and the other fork serving as a support for a gun stock extending at an angle to the gun barrel.

This embodiment enables the support apparatus to be adapted to the length of the sporting gun, since the support member for the gun stock is adjustable with respect to the upper end of the conduit, so that in any case the entire gun barrel extends into the conduit irrespective of the configuration of the remainder of the gun. The forks are disposed at the projecting upper end of the tubular profiled rod in such a manner that the gun barrel is positioned substantially at the longitudinal center of the conduit adjacent the upper end thereof.

In order to ensure that the gun barrel to be cooled extends substantially parallel to the longitudinal center axis of the conduit over its entire length the conduit contains a gun barrel centering support comprising a U-shaped yoke supported at the free ends of its legs for pivotal movement about a pivot axis extending transversally of the longitudinal direction of the conduit and extending into the conduit, the center portion of said yoke being bent into a V-shape for centering the gun barrel, with the apex of said V-shape being directed towards said pivot axis. The pivot axis of the centering yoke is disposed at the underside of the tubular frame member in such a position that even the shortest barrel of a sporting gun may be securely centered.

For adjusting the centering support, the pivot axis of the centering yoke is provided at least at one end thereof with an adjusting lever adapted for pivotal movement between two limit positions, said pivot axis or said adjusting lever carrying a cam engaging a cam follower of a cam follower limit switch for energizing the blower in the limit position corresponding to the centering position of the yoke. This enables centering of the gun barrel and starting of the blower to be carried out in a single operation.

Finally the invention provides that the frame is movable along the ground on ground-engaging rollers or, in an open-air embodiment, on rubber-tired cross-country wheels of larger diameter, and is stationarily positionable on rubber pads in the manner of a tripod. The support apparatus may thus be movably supported on the ground-engaging rollers and be brought to rest substantially immovably on the rubber pads.

BRIEF DESCRIPTION OF THE DRAWING

An embodiment of the invention shall now be described in detail with reference to the accompanying drawing which shows an elevational side view, partially in longitudinal section, of a support apparatus according to the invention.

DETAILED DESCRIPTION

The shown embodiment of an apparatus for supporting a sporting rifle during test firing intervals and for cooling the gun barrel 1 thereof comprises a frame 2 having an isosceles triangular base 3 formed for instance of rectangular tubular frame members. Fixed adjacent each corner of base 3 is a rubber pad 4 for supporting frame 2 stably and substantially immovably on ground 5. A tubular frame member 6 has its lower end affixed to an intermediate portion of one frame member of base 3 to extend upwards at an inclined position relative to base 3 or ground 5, respectively. Adjacent its upper end 7, frame member 6 is supported by upright member 8 extending to the opposite corner portion of base 3, so that base 3, tubular frame member 6 and upright member 8 in the shown side view enclose a triangle with the upper end portion of tubular frame member 6 projecting beyond upright member 8.

In order to enable frame 2 to be readily moved, the frame member of base 3 to which tubular frame member 6 is attached is provided with a pair of ground-engaging rollers 10 supported in bearing blocks 9 affixed to said frame member adjacent a respective rubber pad 4 such that the periphery of said rollers 10 comes to rest on ground 5 only if the frame is lifted at its opposite corner as by upright member 8.

Disposed on tubular frame member 6 extending upwards at an inclined position to ground 5 is a longitudinally enclosed tubular conduit 11 of rectangular or square cross-section extending in the same direction. Conduit 11 gradually widens from its lower end 12 to its upper end 13, thus permitting a sporting rifle with telescopic sight attached to be introduced thereinto. Sealingly connected to lower end 12 of conduit 11 is the outlet sleeve 14 of a high-performance blower 15 driven by an electric motor **15*a* to produce an air flow in the direction of arrows 14*a*. Electric motor 15*a* may be energized via an associated supply cable 16 either from power mains or from a battery or accumulator 2*a* of appropriate capacity carried in frame 2. Starting of electric motor 15*a* is effected via a protective switch by means of a cam follower limit switch 17 which may be carried by upright member 8 of frame 2. In an preferable embodiment the interior surface of conduit 11 is lined or insulated with a heat resistant, resiliently flexible material 18 such as mineral fiber felt serving as a noise dampener and as a protection of a gun barrel 1 introduced into conduit 11** against mechanical damage, while also preventing heating of the conduit.

Slidably supported in tubular member 6 of frame 2 is a tubular profiled rod 19 having a spherical grip handle 20 and adapted to be locked at any position by clamping means 21. At its upper end projecting from tubular frame member 6, tubular profiled rod 19 carries a pair of supports in the form of forks 22 and 23, one of said forks 22 serving to support a gun stock extending substantially in the direction of the gun barrel, the other fork 23 being disposed at an angle of about 90° with respect to said one fork 22 and serving to support a gun stock extending at an angle to the gun barrel.

Supported at the underside of tubular frame member 6 is a pivot axle 26, the ends of which have affixed thereto the legs of a U-shaped yoke 27 extending around the upper side of tubular frame member 6. The legs of yoke 27 enter conduit 11 through slots of appropriate length formed in the adjacent wall thereof. Within conduit 11, the intermediate portion of yoke 27 connecting the legs thereof is bent into a V-shape with its apex pointing towards pivot axle 26, said V-shaped intermediate portion serving to center a gun barrel 1 introduced into conduit 11 for cooling. An adjusting lever 30 connected to pivot axle 26 is movable between two limit positions 28 and 29 for pivoting centering yoke 27 into its position for centering the gun barrel in the longitudinal center of the conduit and away from this position. The centering means is disposed at such a position that also shorter gun barrels may be safely centered within conduit 11.

The cam follower limit switch 17 carried by upright member 8 is disposed such that it is engaged by a cam 31 formed on adjusting lever 30 or on pivot axle 26 in the centering position 29 of adjusting lever 30, thereby closing the energizing circuit of the electric motor **15*a* of blower 15. Starting of blower 15 does thus not require any separate switch actuation, although there may also be provided a separately actuable protective switch for motor 15*a***.

The apparatus may also be used in the open. In this case, base 3 is provided with rubber-tired wheels of larger diameter (not shown) which may preferably be adapted for cross-country travel.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for supporting sporting guns having a gun barrel following test-firing intervals to effect a cooling of said gun barrel, comprising a frame and support means for supporting said sporting gun, said frame including a conduit extending in an inclined relationship to the ground for receiving at least said gun barrel and means for effecting a conducting of a gaseous cooling medium through said conduit and around said gun barrel to effect a cooling thereof.

2. The apparatus according to claim 1, wherein said means for effecting a conducting of a gaseous cooling medium includes a blower driven by an electric motor connected to the lower end of said conduit for feeding said gaseous cooling medium thereto.

3. The apparatus according to claim 1, wherein said conduit gradually widens towards its upper end and has its inner side insulated by means of a heat-resistant, resiliently flexible material.

4. The apparatus according to claim 1, wherein said conduit is supported on a tubular frame member extending in an inclined relationship to the ground and supporting a support member for said sporting gun, said tubular frame member comprising a telescopically extensible and lockable tubular profiled rod carrying at its projecting upper end a pair of support members in the form of forks disposed at an angular spacing of 90°, one of said forks serving as a support member for a gun stock extending substantially in the direction of said gun barrel, and the other fork serving as a support for a gun stock extending at an angle to said gun barrel.

5. The apparatus according to claim 1, wherein said conduit contains a support for centering said gun barrel, said support comprising a U-shaped yoke having the ends of its legs secured to a pivot axle extending transversely of the longitudinal axis of said conduit, an intermediate portion of said yoke extending into said conduit and being bent into a V-shape for centering said gun barrel, with an apex of said V-shape being directed towards said pivot axle.

6. The apparatus according to claim 5, wherein said pivot axle of said centering yoke is connected to an adjusting lever adapted for pivotal movement between two limit positions, said adjusting lever having a cam, wherein a cam follower limit switch is provided having a cam follower engaged by said cam for energizing a blower in a limit position corresponding to the centering position of said yoke.

7. The apparatus according to claim 2, wherein said electric motor driving said blower is adapted to be energized selectively by ac current and dc battery current.

8. The apparatus according to claim 7, wherein said frame has an accumulator thereon of adequate capacity and voltage.

9. The apparatus according to claim 1, wherein said frame is movably supported on the ground by means of ground-engaging rollers and, in an open-air embodiment, by means of rubber-tired cross-country wheels of larger diameter, and is in addition configured as a tripod adapted to be stationarily supported on rubber pads.

* * * * *